United States Patent [19]

Tomimori et al.

[11] 4,343,461

[45] Aug. 10, 1982

[54] PAPER FEEDING CASSETTE

[75] Inventors: Kiyoshi Tomimori; Shunichi Nakajima, both of Yokohama, Japan

[73] Assignee: Tokyo Shibaura Denki Kabushiki Kaisha, Kawasaki, Japan

[21] Appl. No.: 104,062

[22] Filed: Dec. 17, 1979

[30] Foreign Application Priority Data

| | | | |
|---|---|---|---|
| Dec. 20, 1978 | [JP] | Japan | 53-157862 |
| Dec. 20, 1978 | [JP] | Japan | 53-157863 |
| Dec. 20, 1978 | [JP] | Japan | 53-157864 |
| Dec. 20, 1978 | [JP] | Japan | 53-157867 |
| Dec. 20, 1978 | [JP] | Japan | 53-157868 |

[51] Int. Cl.[3] ..... B65H 3/30

[52] U.S. Cl. ..... 271/22; 271/160; 271/171

[58] Field of Search ..... 271/171, 160, 22, 24, 271/127

[56] References Cited

U.S. PATENT DOCUMENTS

| | | | |
|---|---|---|---|
| 3,348,838 | 10/1967 | Springer | 271/24 |
| 3,936,044 | 2/1976 | Kramer | 271/171 X |
| 4,005,794 | 2/1977 | Lundquist | 271/171 X |
| 4,032,136 | 6/1977 | Komaba | 271/171 X |
| 4,106,763 | 8/1978 | Tani | 271/171 X |

FOREIGN PATENT DOCUMENTS

| | | | |
|---|---|---|---|
| 55-41462 | 3/1980 | Japan | 271/127 |

*Primary Examiner*—Richard A. Schacher

*Attorney, Agent, or Firm*—Cushman, Darby & Cushman

[57] ABSTRACT

A paper feeding cassette for receiving paper piles of different widths to be able to replace, comprises a stationary bottom plate on which is disposed the rear portion of the paper pile, a movable bottom plate vertically movable relative to the stationary bottom plate and having the front portion of the paper pile disposed thereon, springs for upwardly urging the movable bottom plate, a movable side plate regulating the other side edge of the paper pile, and separation pawl for enabling the uppermost paper alone of the paper pile to be fed. The movable bottom plate has a width not smaller than the width of the largest paper which can be housed in the cassette, and the side plate is movable along the movable bottom plate so as to allow the side edges of the paper pile of a width smaller than the width of the largest paper to be regulated.

11 Claims, 14 Drawing Figures

PAPER FEEDING CASSETTE

BACKGROUND OF THE INVENTION

This invention relates to a paper feeding cassette, particularly, to a paper feeding cassette for use in an electronic copying apparatus.

In general, a paper feeding cassette is mounted to the body of an electronic copying apparatus and houses a pile of a number of sheets of paper.

FIGS. 1 and 2 appended hereto collectively show a conventional paper feeding cassette 10. It is seen that the cassette 10 comprises a box-like body 12, a vertically movable bottom plate 16, a rear upright plate 18 and a movable side plate 20. The front portion of a paper pile 14 housed in the body 12 is disposed on the movable bottom plate 16. Further, the rear and side edges of the paper pile 14 are regulated by the plates 18 and 20, respectively. The bottom plate 16 is upwardly urged by a pair of main springs 22 and a pair of auxiliary springs 24 such that the uppermost paper of the paper pile 14 abuts against a take-up roller 26 of an electronic copying apparatus.

The conventional paper feeding cassette 10 described above necessitates a plurality of movable bottom plates of different widths. Specifically, where a paper of a different width is used, a movable bottom plate of a suitable width should be used in accordance with the width of the paper. Naturally, it is very troublesome to replace the movable bottom plate. In addition, a cassette necessitating a plurality of movable bottom plates is not desirable in terms of the required space and cost.

SUMMARY OF THE INVENTION

An object of this invention is to provide a paper feeding cassette simple in construction and capable of handling paper piles of differing widths without replacing a movable bottom plate.

DETAILED DESCRIPTION OF THE PREFERRED EMBODIMENT

Figure 1:
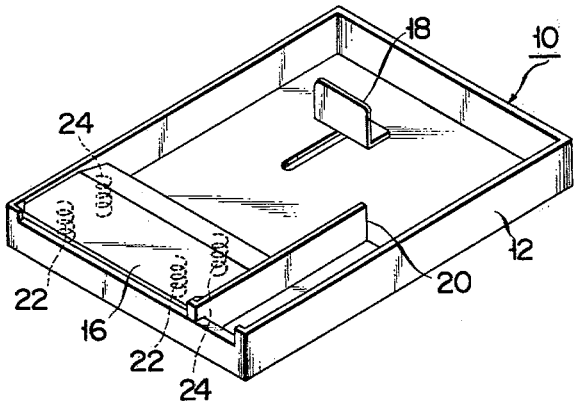
FIG. 1 PRIOR ART
FIGS. 1 and 2 are an oblique view and a cross sectional view, respectively, of a conventional paper feeding cassette.
Figure 2:
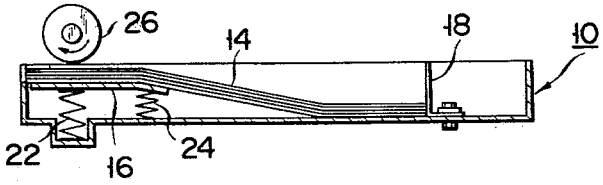
FIG. 2 PRIOR ART
Figure 4:
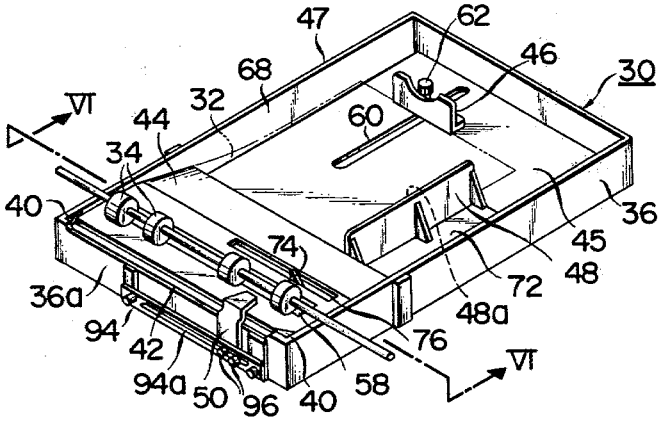
FIG. 4 is an oblique view schematically showing the body of the paper feeding cassette shown in FIG. 3.
Figure 3:
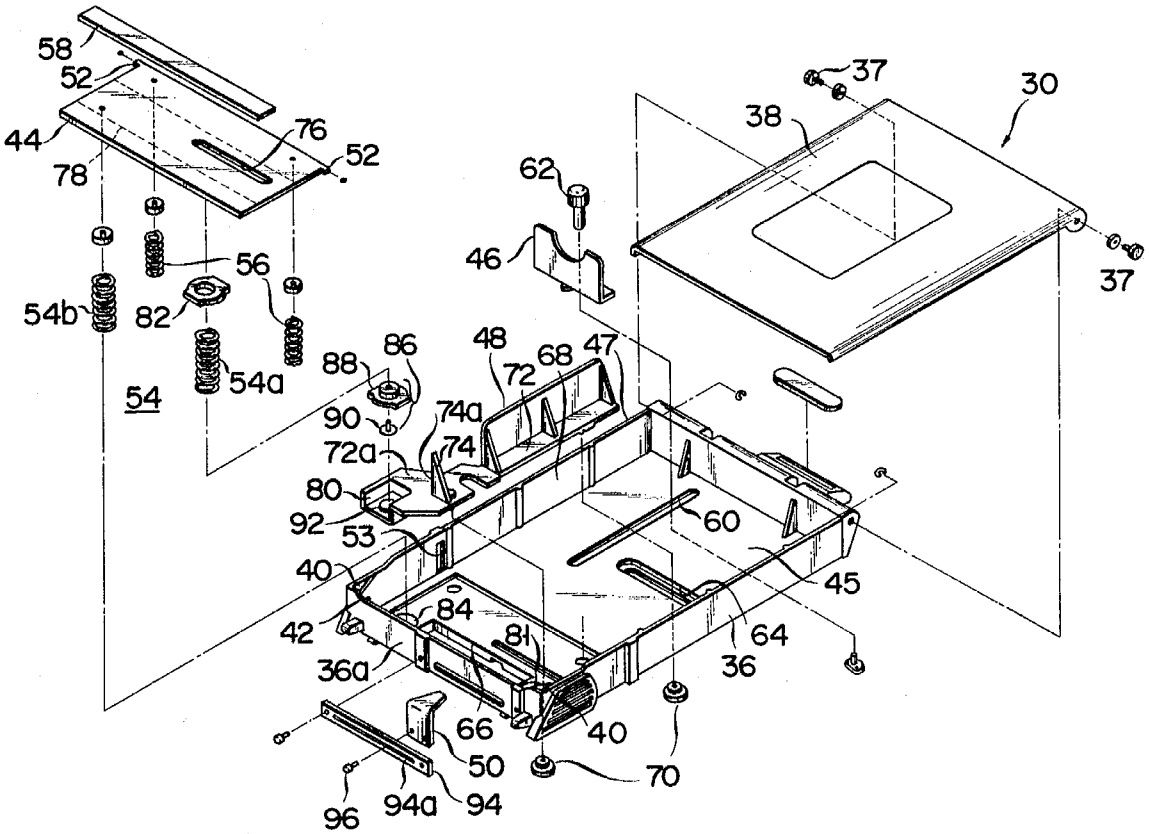
FIG. 3 is an oblique view showing the dismantled state of a paper feeding cassette according to one embodiment of this invention.

FIGS. 3 to 8 collectively show a paper feeding cassette according to one embodiment of this invention. Specifically, a paper feeding cassette 30 shown in FIGS. 3 and 4 is mounted to an electronic copying apparatus, not shown. The uppermost paper of a paper pile 32 housed in the cassette 30 is in contact with take-up rollers 34 of the electronic copying apparatus.

The cassette 30 comprises a cassette body 36 and a lid 38 rotatably pivoted by a pair of pins 37 to the rear end of the cassette body 36, i.e., the rear end with respect to the paper take-up direction. The width of the cassette body 36 is determined in conformity with the width of the largest paper housed in the cassette body 36. On the other hand, the upper plane of the cassette body 36 except the front portion is covered with the lid 38. A pair of stationary separation pawls 40 serving to hold the paper pile 32 are mounted to the front corners of the cassette body 36. Incidentally, the pawls 40 serve to hold the paper pile 32 such that the uppermost paper alone of the pile 32 is fed to the desired portion. A recess 42 is formed on the upper end portion of a front wall **36*a* of the cassette body 36** so as to facilitate feeding the paper.

The front and rear portions of the paper pile 32 are disposed on a movable bottom plate 44 and a stationary bottom plate 45, respectively. The rear end of the paper pile 32 housed in the cassette 30 is regulated by a rear upright plate 46. On the other hand, the side edges of the paper pile 32 are regulated by a stationary side wall 47 (i.e., first side plate) and a movable side plate 48 (i.e., second side plate). It is seen that a movable separation pawl 50 is mounted to the front wall **36*a* of the cassette body 36. Naturally, the pawl 50 is movable sideways along the front wall 36*a***.

The movable bottom plate 44 extends to cover the entire width of the cassette body 36 and is vertically movable. The rear corners of the plate 44 are provided with a pair of guide projections 52 which extend sideways so as to be engaged with a pair of vertical slits 53 formed in the side walls of the cassette body 36. Naturally, the projections 52 are allowed to slide within the slits 53 so as to regulate the vertical movement of the movable bottom plate 44. As seen from the drawing, the plate 44 is kept urged upward by a main spring assembly 54 consisting of a movable coil spring **54*a* and a stationary coil spring 54*b* as well as by a pair of auxiliary coil springs 56 positioned behind the main spring assembly 54. It follows that the paper pile 32 disposed on the movable bottom plate 44 is kept slightly pushed against the pair of stationary separation pawls 40 or against one of the stationary separation pawls 40 and the movable separation pawl 50. Incidentally, the coil springs 54*a* and 54*b*, which constitute the main spring assembly 54, are positioned appropriately apart from each other in the width direction of the movable bottom plate 44. Likewise, the auxiliary coil springs 56 are also apart from each other in the width direction of the plate 44**.

A friction tape 58 is fixed to the front portion of the upper surface of the movable bottom plate 44. The friction tape 58, which extends substantially across the width of the plate 44, serves to ensure that the uppermost paper alone is fed into the copying apparatus even when the paper pile 32 consists of a few sheets of paper.

The rear upright plate 46 is movable back and forth along a slit 60 formed in the stationary bottom plate 45 and is fixed to a desired position by a screw 62 in accordance with the length of the paper pile 32 housed in the cassette 30.

The movable side plate 48 is movable sideways. Specifically, the plate 48 is mounted to a support arm 72 movable sideways along slits 64 and 66 formed in the stationary bottom plate 45. The support arm 72 is fixed to a desired position by screws 70 such that the side edges of the paper pile 32 housed in the cassette 30 are regulated by the inner surface 68 of the stationary side wall 47 of the cassette body 36 and the movable side plate 48.

Figure 5:
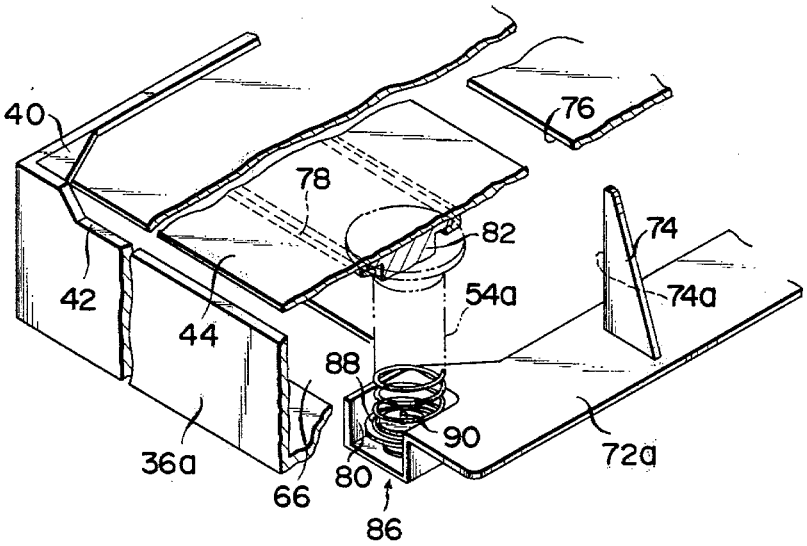
FIG. 5 is an oblique view showing the front portion partly broken away, of the paper feeding cassette shown in FIG. 3.

As seen from FIG. 5, the support arm 72 supporting the movable side plate 48 extends into the region beneath the movable bottom plate 44, namely, the arm 72 comprises an extended portion 72*a*. A guide projection 74 having a guide plane 74*a* is mounted to the upper surface of the extended portion 72*a*. It is important to note that the guide plane 74*a* and a guide plane 48*a* (see FIG. 4) of the movable side plate 48 are included in a single plane. The movable bottom plate 44 is provided with a slit 76 along which the tip portion of the guide projection 74 is movable sideways.

The extended portion 72*a* of the support arm 72 is provided at the front edge portion with a spring-receiving recess 80 movable along the slit 66 formed in the front portion of the stationary bottom plate 45. The recess 80 is movable along the slit 66 and, thus, also acts as a guide means of the support arm 72. The lower end of the movable coil spring 54*a* included in the main spring assembly 54 is supported by the bottom of the recess 80. On the other hand, the upper end of the spring 54*a* mentioned above is supported by a holder 82 slidable along a guide rail 78 formed in the underside of the movable bottom plate 44. It follows that the movable side plate 48 and the movable coil spring 54*a* are moved together. Incidentally, FIG. 3 shows a spring-receiving recess 81 formed in the stationary bottom plate 45. When the movable side plate 48 has been removed, the lower end of the movable coil spring 54*a* is supported by the recess 81.

Figure 6:
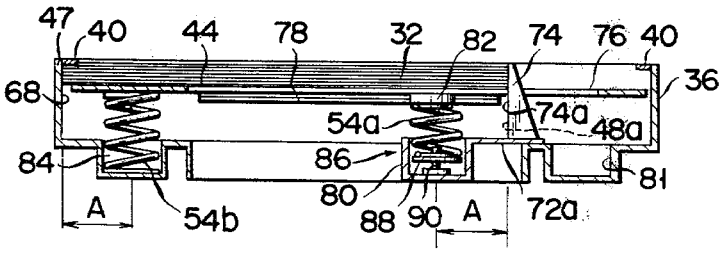
FIG. 6 is a cross sectional view along line VI—VI of FIG. 4.

FIG. 6 shows that the stationary bottom plate 45 is also provided with a recess 84 serving the support the lower end of the stationary coil spring 54*b* included in the main spring assembly 54. The distance A between the axis of the stationary coil spring 54*b* and the inner surface 68 of the stationary side wall 47 is made equal to the distance A between the axis of the movable coil spring 54*a* and the guide plane 48*a* or 74*a* of the movable side plate 48 or guide projection 74.

A means 86 for adjusting the urging force of the movable coil spring 54*a* is housed in the spring-receiving recess 80 as seen from FIGS. 5 and 6. The urging forceadjusting means 86 consists of a movable member 88 directly supporting the lower end of the movable coil spring 54*a* and a screw 90 serving to adjust the vertical position of the movable member 88. The screw 90 is inserted into the recess 80 through a hole 92 formed in the bottom of the recess 80 for engagement with the movable member 88.

Figure 7:
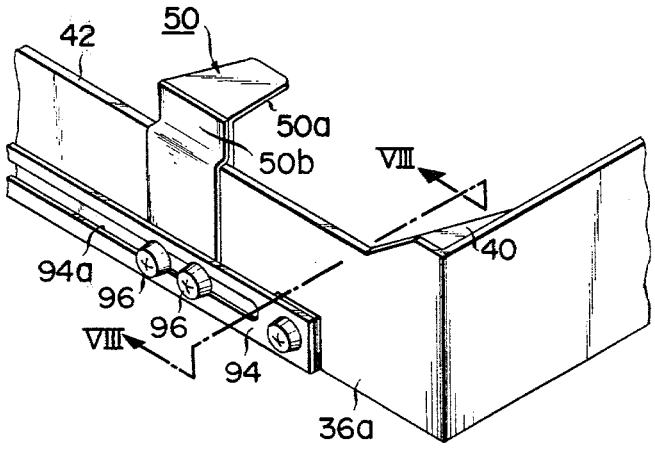
FIG. 7 is an oblique view showing the paper-holding mechanism of the paper feeding cassette shown in FIG. 3.
Figure 8:
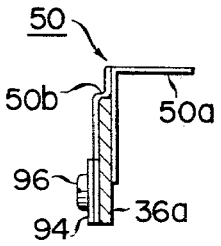
FIG. 8 is a cross sectional view along line VIII—VIII of FIG. 7.

The movable separation pawl 50 consists of a pawl body 50*a* and a support member 50*b* as seen from FIGS. 7 and 8. The pawl body 50*a* upwardly extends along the inner surface of the front wall 36*a* of the cassette body 36 and is folded at right angles toward the interior of the cassette body 36, the folded portion being slightly above the upper surface of the front wall 36*a*. On the other hand, the support member 50*b* covers the outer surface and upper surface of the front wall 36*a* as well as the outer surface of the pawl body 50*a* at the portion which does not face the front wall 36*a*. It follows that the upper portion of the front wall 36*a* is held between the pawl body 50*a* and the support member 50*b*. Incidentally, the pawl body 50*a* and the support member 50*b* are bonded to each other at the contact area.

As described previously, the separation pawl 50 is movable along the front wall 36*a* of the cassette body 36. In order to control the movement of the pawl 50, a guide rail 94 having a slit 94*a* formed in the central portion thereof is mounted to the outer surface of the front wall 36*a*. The guide rail 94 is slightly apart from the front wall 36*a* such that the lower portion of the support member 50*b* of the pawl 50 extends downward through the clearance. Screws 96 are inserted through the slit 94*a* of the guide rail 94 for engagement with the support member 50*b* of the movable separation pawl 50 so as to fix the pawl 50 to the desired position of the front wall 36*a* of the cassette body 36.

For operating the paper feeding cassette described above, the paper pile 32 is housed first in the cassette body 36 such that the front edge and one side edge of the paper pile 32 are regulated by the inner surfaces of the front wall 36*a* and the inner surface 68 of stationary side wall 47 of the cassette body 36, respectively. Then, the rear upright plate 46 and the movable side plate 48 are suitably moved to regulate the rear edge and the other side edge of the paper pile 32. Naturally, the movable separation pawl 50 is also moved sideways in accordance with the movement of the movable side plate 48. When the paper pile 32 has been set as desired, the front corners of the paper pile 32 are positioned beneath the separation pawls 40 and 50. In addition, the movable bottom plate 44 is upwardly urged by the main spring assembly 54 and the auxiliary coil springs 56 as described previously. It follows that the front portion of the paper pile 32 is upwardly pushed against the separation pawls 40 and 50. Incidentally, the distance A between the stationary coil spring 54*b* and the stationary side wall 47 is equal to the distance A between the movable coil spring 54*a* and the movable side plate 48 as described previously (see FIG. 6). Therefore, the magnitude of the urging force transmitted from the main spring assembly 54 to the stationary separation pawl 40 is rendered equal to that transmitted to the movable separation pawl 50 regardless of the width of the paper pile 32.

As described previously, the guide projection 74 extending upward through the slit 76 of the movable bottom plate 44 is integral with the movable side plate 48. Thus, the guide projection 74 is moved together with the movable side plate 48, resulting in that the front portion of the paper pile 32 is guided to the desired position without fail.

For the case of using a paper pile having a width equal to the width of the cassette body 36, it is necessary to remove the movable separation pawl 50 and the movable side plate 48. Further, the lower end of the movable coil spring 54*a* included in the main spring assembly 54 is supported by the spring-receiving recess 81 formed in the stationary bottom plate 45 of the cassette body 36. Of course, the front corners of the paper pile are positioned beneath the stationary separation pawls 40 in this case.

The paper feeding cassette 30 having the paper pile 32 housed therein as desired is mounted to an electronic copying apparatus. In this case, the front portion of the paper pile 32 is brought into contact with the take-up rollers 34 of the copying apparatus as shown in FIG. 4. Naturally, the uppermost paper in direct contact with the take-up rollers 34 is fed into the copying apparatus in accordance with rotation of the rollers 34. In this fashion, the paper is fed sheet by sheet from the paper pile 32 into the electronic copying apparatus.

Incidentally, the separation pawl 50 can be moved independently, rendering it possible to adjust the location of the pawl 50 in accordance with the hardness and thickness of the paper used.

Figure 9:
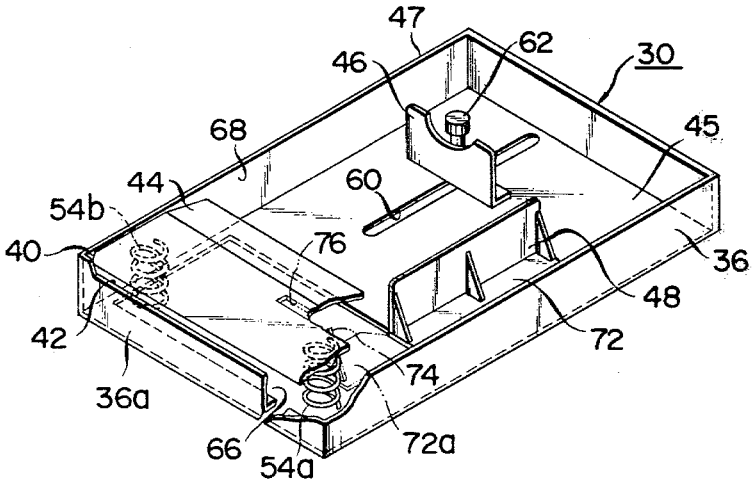
FIGS. 9 and 10 are an oblique view and a cross sectional view, respectively, of a paper feeding cassette according to another embodiment of this invention.
Figure 10:
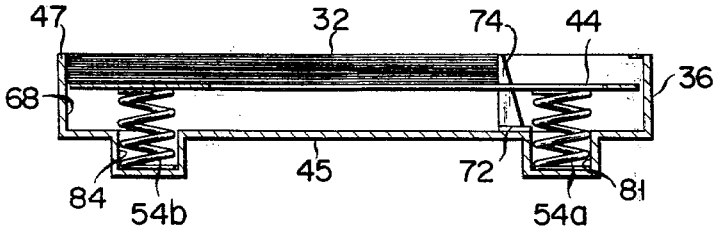

In the foregoing embodiment, the support arm 72 supporting the movable side plate 48 is provided with the spring-receiving recess 80 serving to receive the lower portion of the movable coil spring 54*a* included in the main spring assembly 54. But, the support arm 72 may not be provided with the recess 80 as shown in FIGS. 9 and 10. In this case, the lower portion of the coil spring 54*a* is received by the recess 81 formed in the stationary bottom plate 45. Preferably, the distance between the recess 81 and one side edge of the movable bottom plate should be equal to the distance between the recess 84 and the other side edge of the movable bottom plate.

Figure 11:
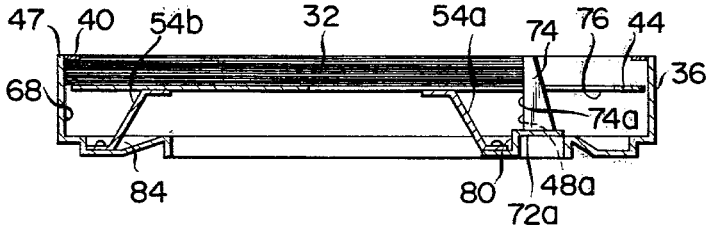
FIG. 11 is a cross sectional view showing a paper feeding cassette according to further embodiment of this invention.

In the foregoing embodiment, the coil spring 54*a* and 54*b* are used as the urging means. But, it is possible to use leaf springs 54*a*, 54*b* in place of the coil springs as shown in FIG. 11. Naturally, the lower ends of the leaf springs 54*a*, 54*b* are fixed to the bottoms of the spring-receiving recesses 80, 84, respectively.

Figure 12:
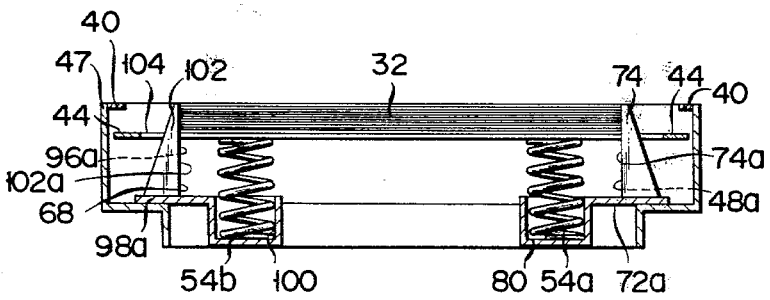
FIGS. 12 and 13 are a cross sectional view and an oblique view, respectively, of a paper feeding cassette according to still further embodiment of this invention.
Figure 13:
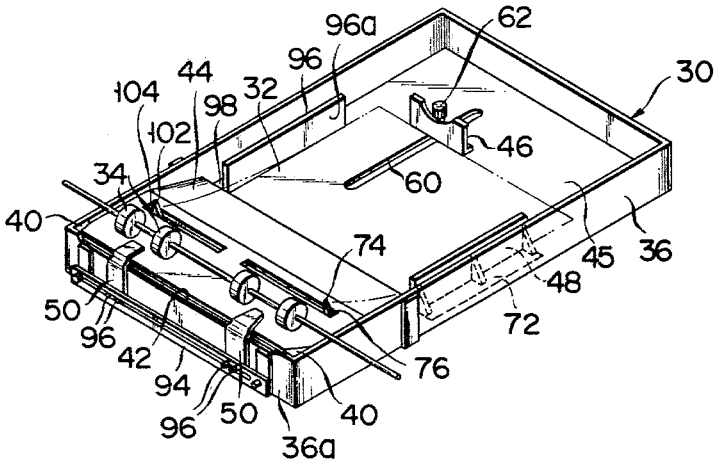
Figure 14:
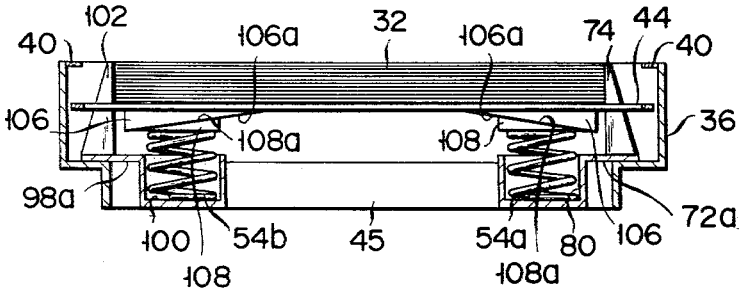
FIG. 14 is a cross sectional view showing a paper feeding cassette according to still further embodiment of this invention.

FIGS. 12 and 13 collectively show an additional modification to the foregoing embodiment. Specifically, the paper feeding cassette shown in FIGS. 12 and 13 is provided with a second side plate 96 independently movable sideways. In this case, the side edges of the paper pile are regulated by a pair of movable side plates 48 and 96. In other words, the movable side plate 96 acts as the first side plate. As seen from the drawings, the second movable side plate 96 is supported by a second support arm 98. As is the case with the support arm 72 described previously, the second support arm 98 extends forward to reach the region beneath the movable bottom plate 44, i.e., has an extended portion 98*a*. A second spring-receiving recess 100 serving to receive the lower portion of the coil spring 54*b* included in the main spring assembly 54 is formed in the tip portion of the extended portion 98*a*. In other words, the coil springs 54*a*, 54*b* are both movable in the embodiment of FIGS. 12 and 13. Further, a second guide projection 102 is mounted on the second support arm 98. Still further, the movable bottom plate 44 is provided with a slit 104 along which moves the tip portion of the second guide projection 102. Naturally, the projection 102 has a guide plane 102*a* which is aligned with a guide plane 96*a* of the second movable side plate 96. It should also be noted that the embodiment of FIGS. 12 and 13 necessitates an additional movable separation pawl 50. In other words, the front corners of the paper pile are supported by a pair of movable separation pawls 50.

Where the coil springs 54*a* and 54*b* are both movable as in the embodiment of FIGS. 12 and 13, the urging force-adjusting means 86 shown in FIG. 6, i.e., the means consisting of the movable member 88 and the screw 90, may be replaced by the mechanism shown in FIG. 14. Specifically, FIG. 14 shows that a pair of guide plates 106 are attached to the underside of the movable bottom plate 44. The guide plates 106 are provided with a pair of spring-receiving members 108 serving to receive the upper ends of the coil springs 54*a*, 54*b* and slidable along the guide plate 106. It follows that the coil springs 54*a* and 54*b* are moved sideways together with the movement of the movable side plates 48 and 96, respectively. As shown in the drawing, each of the guide plate 106 and the spring-receiving member 108 is triangular in cross section. The two triangles are similar to each other. The underside of the guide plate 106 constituting a guide plane 106*a* is inclined such that the guide plane 106*a* is elevated toward the center of the movable bottom plate 44. The upper face of the spring-receiving member 108 constituting a guide plate 108*a* is naturally parallel with the guide plane 106*a* of the guide plate 106. In addition, the member 108 grows thinner toward the side edge of the movable bottom plate 44. It follows that the underside of the member 108 is kept parallel with the bottom of the recess 100 or 80 wherever the coil springs 54*a*, 54*b* constituting the main spring assembly 54 have been moved. The mechanism of FIG. 14 described above permits adjusting the urging force of the main spring assembly 54 by moving sideways the coil springs 54*a* and 54*b* as desired. Specifically, the urging force can be increased by moving the coil springs 54*a* and 54*b* toward the side edges of the movable bottom plate 44, and vice versa. Incidentally, the same members of the paper feeding cassette are denoted by the same reference numerals throughout FIGS. 3 to 14.

As described above in detail, the paper feeding cassette of this invention comprises a movable bottom plate having a width not smaller than the width of the largest paper housed in the cassette and a side plate movable sideways. The bottom plate mentioned is vertically movable. When a paper pile of a width smaller than the width of the movable bottom plate is housed in the cassette, the side plate is moved such that the side edges of the paper pile are regulated by the second side plate and the first side wall of the cassette body. The particular construction is advantageous in that the movable bottom plate need not be replaced in using a paper pile of a different width. Of course, the location of the movable bottom plate need not be re-adjusted, either. It follows that the paper feeding cassette of this invention permits markedly facilitating the replacement of paper piles.

What we claim is:

1. In a paper feeding cassette for receiving paper piles of different widths, comprising a cassette body including a stationary bottom plate on which is disposed the rear portion of the paper pile with respect to the take-up direction of the paper, a movable bottom plate vertically movable relative to the stationary bottom plate in the cassette body and having the front portion of the paper pile disposed thereon, means for upwardly urging the movable bottom plate, a first side plate regulating one side edge of the paper pile, a second side plate regulating the other side edge of the paper pile, a front wall regulating the front edge of the paper pile, and separation means for enabling the uppermost paper alone of the paper pile to be fed; the improvement in which:

(1) the first side plate is a stationary side wall fixed to the stationary bottom plate, (2) the movable bottom plate has a width not smaller than the width of the largest paper which can be housed in the cassette body, (3) the second side plate is attached to the stationary bottom plate and movable in the direction perpendicular to the paper-feeding direction so as to allow the side edges of the paper pile of a width smaller than the width of the largest paper to be regulated by the first and second side plates, (4) the urging means includes a stationary coil spring stretched between the stationary bottom plate and the movable bottom plate and a movable coil spring spaced apart from said stationary coil spring in the width direction of the movable bottom plate and movable sideways together with the second side plate, and (5) the cassette further includes a rear upright plate movable back and forth relative to the stationary bottom plate for regulating the rear edge of the paper pile.

2. The cassette according to claim 1, wherein the second side plate includes a support arm with an end portion extending below the movable bottom plate, the lower end of the movable main coil spring immovably supported by the extended end portion of the support arm, with the upper end of the main movable coil spring being slidably supported by the underside of the movable bottom plate.

3. The cassette according to claim 2, wherein the distance between the stationary main coil spring and the first side plate is equal to the distance between the movable coil spring and the second side plate.

4. The cassette according to claim 3, wherein the extended end portion of said support arm has a guide projection mounted thereon, against which abuts the side edge of the paper pile and the movable bottom plate is provided with a slit through which the guide projection extends upward.

5. The cassette according to claim 4, wherein said separation means includes a pair of stationary separation pawls fixed to the side edges of the front wall thereby being capable of supporting the front corners of the uppermost paper of the paper pile.

6. The cassette according to claim 5, wherein the separation means comprises a movable separation pawl movable along the front wall.

7. The cassette according to claim 6, wherein the movable separation pawl comprises a pawl body upwardly extending along the inner surface of the front wall and folded toward the interior of the cassette body, the folded portion being slightly above the front wall, and a support member covering the outer surface and upper surface of the front wall and the outer surface of the pawl body at the portion which does not face the front wall.

8. The cassette according to claim 7, wherein the movable separation pawl and the second side plate are respectively removable from the front wall and stationary bottom plate for using the paper pile of the largest width.

9. In a paper feeding cassette for receiving paper piles of different widths, comprising a cassette body including a stationary bottom plate on which is disposed the rear portion of the paper pile with respect to the take-up direction of the paper, a movable bottom plate vertically movable relative to the stationary bottom plate in the cassette body and having the front portion of the paper pile disposed thereon, means for upwardly urging the movable bottom plate, a first side plate regulating one side edge of the paper pile, a second side plate regulating the other side edge of the paper pile, a front wall regulating the front edge of the paper pile, and separation means for enabling the uppermost paper alone of the paper pile to be fed;

the improvement in which:

(1) the movable bottom plate has a width not smaller than the width of the largest paper which can be housed in the cassette body, (2) the second side plate is attached to the stationary bottom plate and movable in the direction perpendicular to the paper-feeding direction so as to allow the side edges of the paper pile of a width smaller than the width of the largest paper to be regulated by the first and second side plates, (3) the first side plate is movable along the movable bottom plate, (4) the urging means includes a pair of coil springs provided apart from each other in the width direction of the movable plate and movable sideways together with the first and second side plates, and (5) the cassette further includes a rear upright plate movable back and forth relative to the stationary bottom plate for regulating the rear edge of the paper pile.

10. The cassette according to claim 9, wherein the underside of the movable bottom plate is provided with a pair of guide plates having inclined guide planes serving to guide the pair of movable coil springs for adjusting the urging force of the coil springs.

11. The cassette according to any one of claims 1, 2 to 8 and 9, wherein the urging means is provided with an urging force-adjusting means.

* * * * *